US006347465B1

(12) United States Patent
Jensen

(10) Patent No.: US 6,347,465 B1
(45) Date of Patent: Feb. 19, 2002

(54) PLOW BLADE DEFLECTOR SYSTEM

(76) Inventor: Leland E. Jensen, 2947 Tyler Pkwy., Bismarck, ND (US) 58501

( * ) Notice: Subject to any disclaimer, the term of this patent is extended or adjusted under 35 U.S.C. 154(b) by 0 days.

(21) Appl. No.: 09/535,430

(22) Filed: Mar. 23, 2000

(51) Int. Cl.[7] ..... E01H 5/06
(52) U.S. Cl. ..... 37/280; 37/266
(58) Field of Search ..... 37/274, 275, 279, 37/280, 281, 266, 268, 270; 172/810, 811, 817, 271, 430; E01H 5/06

(56) References Cited

U.S. PATENT DOCUMENTS 2,085,996 A * 7/1937 Phillips ..... 37/42
2,218,512 A * 10/1940 Ball ..... 37/42
3,208,166 A * 9/1965 Proulx ..... 37/42
3,231,991 A * 2/1966 Wandscheer et al. ..... 37/42
3,373,515 A * 3/1968 Schneider ..... 37/50
3,374,562 A * 3/1968 Glesmann ..... 37/50
3,407,519 A * 10/1968 Batko ..... 37/42
3,604,517 A * 9/1971 Clifford ..... 172/225
4,145,825 A * 3/1979 Bertolino ..... 37/42
4,208,812 A * 6/1980 Brownly ..... 37/71
4,217,707 A * 8/1980 Karlsson ..... 37/41
4,446,639 A * 5/1984 Bohn ..... 37/280
4,491,275 A * 1/1985 Holsworth ..... 239/663
4,890,400 A * 1/1990 Long ..... 37/117.5
5,375,349 A * 12/1994 Jochim ..... 37/329
5,409,068 A * 4/1995 Hake et al. ..... 172/196
5,509,219 A * 4/1996 Mecca ..... 37/231
6,009,642 A * 1/2000 Nugent ..... 37/231

* cited by examiner

*Primary Examiner*—Thomas B. Will
*Assistant Examiner*—Kristine Markovich

(57) ABSTRACT

A plow blade deflector system for reducing the size of windrows thrown to the side of a plow blade. The inventive device includes a first bracket and a second bracket attachable to the upper edge of a plow blade, a pivot structure attached to the brackets, an arm member pivotally attached to the pivot structure, an actuator attached to the plow blade and to a distal end of the arm member, an upper member attached to the arm member, and a deflector member vertically attached to the upper member. The deflector member preferably includes a plurality of brace members extending from the upper member to the deflector member for providing additional support during usage. The deflector member preferably extends at an acute angle with respect to the deflector member so as to be substantially parallel to a curb during usage. The actuator allows the operator of the snowplow to elevate the deflector member during normal usage thereby allowing the snow to be diverted to the side of the snowplow. When the snowplow encounters a driveway or other area where the operator desires to remain clear of snow, the operator manipulates the actuator so as to lower the deflector member thereby capturing a significant portion of the snow thereby maintaining the path of the driveway unobstructed. When the snowplow passes the driveway, the operator manipulates the actuator to raise the deflector member thereby allowing the accumulated snow to pass to the side of the plow blade.

18 Claims, 4 Drawing Sheets

PLOW BLADE DEFLECTOR SYSTEM

BACKGROUND OF THE INVENTION

1. Field of the Invention

The present invention relates generally to snow plow blades and more specifically it relates to a plow blade deflector system for reducing the size of windrows thrown to the side of a plow blade.

2. Description of the Prior Art

Plow blades have been in use for years. Typically, a blade is an elongated structure having a lower blade edge for engaging material such as snow, ice dirt or gravel. The blade typically is attached to a vehicle such as a tractor or truck. The blade can also typically be raised, lowered, tilted, and pivoted to allow control of the material. Often times is desirable for a snow plow operator to divert the material to the side of the road surface thereby clearing the roadway of snow and ice.

However, the main problem with conventional plow blades is that the windrow created to the side of the plow blade can be relatively tall making it difficult for individuals to leave their driveway. The vehicle of a homeowner may become lodged within the windrow of snow and potentially damaging the vehicle.

Examples of patented snow plow devices include U.S. Pat. No. 5,860,230 to Daniels; U.S. Pat. No. 4,614,048 to Melby; U.S. Pat. No. 4,208,812 to Brownly; U.S. Pat. No. 5,758,728 to Ragule; U.S. Pat. No. 5,899,007 to Niemela et al.; U.S. Pat. No. 5,903,986 to Parker; U.S. Pat. No. 4,479,312 to Turgeon; U.S. Pat. No. 4,217,707 to Karlsson; U.S. Pat. No. 3,477,151 to Zanella; U.S. Pat. No. 5,285,588 to Niemela et al. which are all illustrative of such prior art.

While these devices may be suitable for the particular purpose to which they address, they are not as suitable for reducing the size of windrows thrown to the side of a plow blade. Conventional plow blade devices do not reduce the size of a windrows placed in front of a driveway or other path.

In these respects, the plow blade deflector system according to the present invention substantially departs from the conventional concepts and designs of the prior art, and in so doing provides an apparatus primarily developed for the purpose of reducing the size of windrows thrown to the side of a plow blade.

SUMMARY OF THE INVENTION

In view of the foregoing disadvantages inherent in the known types of plow blades now present in the prior art, the present invention provides a new plow blade deflector system construction wherein the same can be utilized for reducing the size of windrows thrown to the side of a plow blade.

The general purpose of the present invention, which will be described subsequently in greater detail, is to provide a new plow blade deflector system that has many of the advantages of the plow blades mentioned heretofore and many novel features that result in a new plow blade deflector system which is not anticipated, rendered obvious, suggested, or even implied by any of the prior art plow blades, either alone or in any combination thereof.

To attain this, the present invention generally comprises a first bracket and a second bracket attachable to the upper edge of a plow blade, a pivot structure attached to the brackets, an arm member pivotally attached to the pivot structure, an actuator attached to the plow blade and to a distal end of the arm member, an upper member attached to the arm member, and a deflector member vertically attached to the upper member. The deflector member preferably includes a plurality of brace members extending from the upper member to the deflector member for providing additional support during usage. The deflector member preferably extends at an acute angle with respect to the deflector member so as to be substantially parallel to a curb during usage. The actuator allows the operator of the snowplow to elevate the deflector member during normal usage thereby allowing the snow to be diverted to the side of the snowplow. When the snowplow encounters a driveway or other area where the operator desires to remain clear of snow, the operator manipulates the actuator so as to lower the deflector member thereby capturing a significant portion of the snow thereby maintaining the path of the driveway unobstructed. When the snowplow passes the driveway, the operator manipulates the actuator to raise the deflector member thereby allowing the accumulated snow to pass to the side of the plow blade.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a plow blade deflector system that will overcome the shortcomings of the prior art devices.

A second object is to provide a plow blade deflector system for reducing the size of windrows thrown to the side of a plow blade.

Another object is to provide a plow blade deflector system that reduces the chances that a vehicle will become lodged within a windrow of snow or other material.

An additional object is to provide a plow blade deflector system that can be utilized on most plow blades.

A further object is to provide a plow blade deflector system that can be utilized upon the left or right side of a plow blade.

Another object is to provide a plow blade deflector system that reduces the amount of snow left in front of driveways and intersections during snow plow operations.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
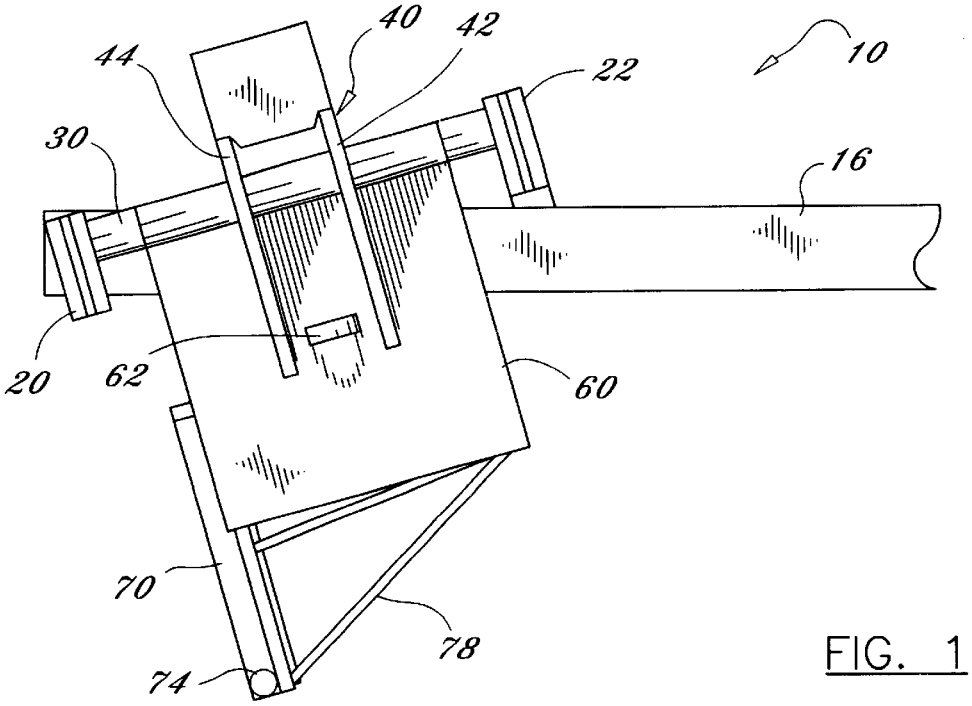
FIG. 1 is a top view of the present invention attached to plow blade.

Turning now descriptively to the drawings, in which similar reference characters denote similar elements throughout the several views, FIGS. 1 through 5 illustrate a plow blade deflector system 10, which comprises a first bracket 20 and a second bracket 22 attachable to the upper edge 16 of a plow blade 12, a pivot structure 30 attached to the brackets, an arm member 40 pivotally attached to the pivot structure 30, an actuator 50 attached to the plow blade 12 and to a distal end of the arm member 40, an upper member 60 attached to the arm member 40, and a deflector member 70 vertically attached to the upper member 60. The deflector member 70 preferably includes a plurality of brace members 78 extending from the upper member 60 to the deflector member 70 for providing additional support during usage. The deflector member 70 preferably extends at an acute angle with respect to the plow blade 12 so as to be substantially parallel to a curb during usage. The actuator 50 allows the operator of the snowplow to elevate the deflector member 70 during normal usage thereby allowing the snow to be diverted to the side of the snowplow. When the snowplow encounters a driveway or other area where the operator desires to remain clear of snow, the operator manipulates the actuator 50 so as to lower the deflector member 70 thereby capturing a significant portion of the snow thereby maintaining the path of the driveway unobstructed. When the snowplow passes the driveway, the operator manipulates the actuator 50 to raise the deflector member 70 thereby allowing the accumulated snow to pass to the side of the plow blade 12.

As shown in FIGS. 1 through 5 of the drawings, a conventional plow blade 12 has a lower blade 14 and an upper edge 16. The plow blade 12 typically has an arcuate cross sectional area for deflecting the snow and other debris downwardly. The plow blade 12 is attached to a vehicle commonly referred to as a snowplow. The plow blade 12 may be elevated, tilted, rotated or lowered utilizing well-known mechanical means.

It is to be understood that the below detailed description of the present invention only describes attachment to one end of the plow blade 12 for the purpose of brevity. It is further understood that the present invention may be attached to any opposing end of the plow blade 12 either as one unit or two opposing units.

Figure 5:
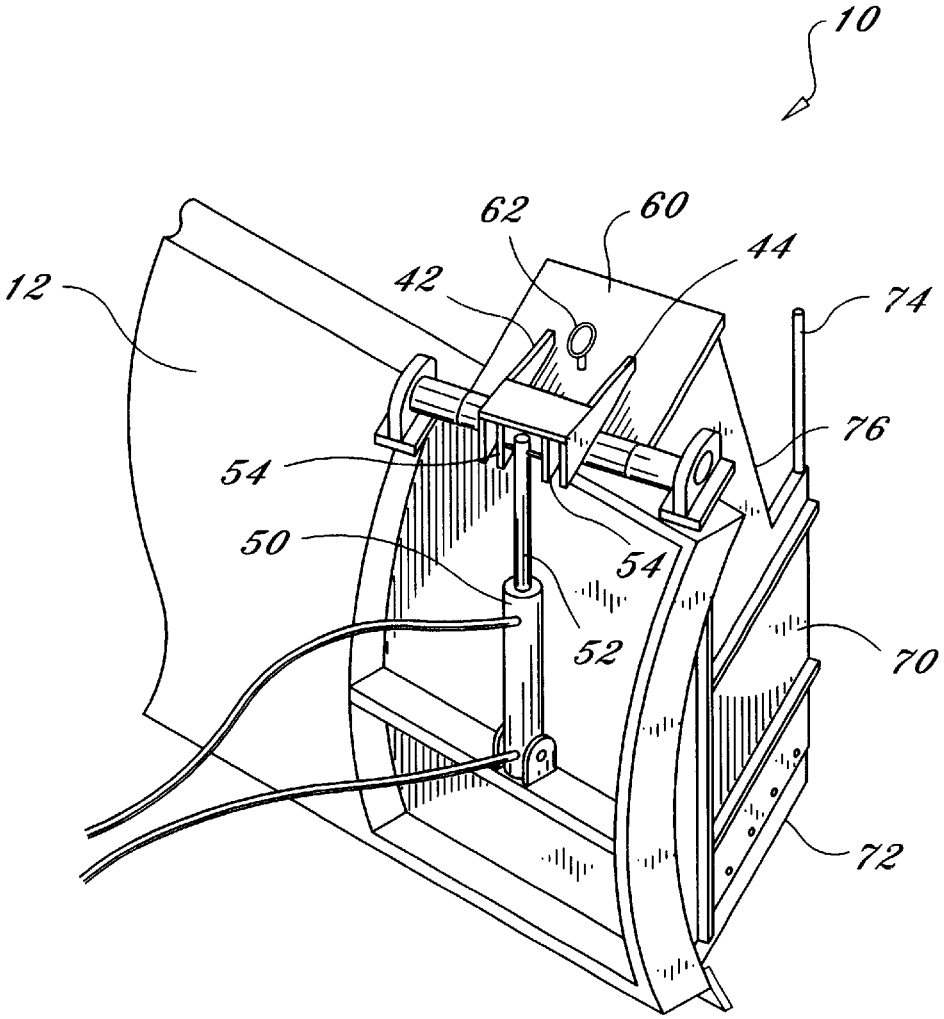
FIG. 5 is a rear upper perspective view of the present invention.

As shown in FIGS. 1 and 5 of the drawings, a first bracket 20 and a second bracket 22 are attached to the upper edge 16 of the plow blade 12. The brackets 20, 22 may be comprised of any known bracket structure and may be secured to the upper edge 16 of the plow blade 12 with any known means of attachment. It can be appreciated that one or more brackets 20, 22 may be utilized with the present invention.

Figure 2:
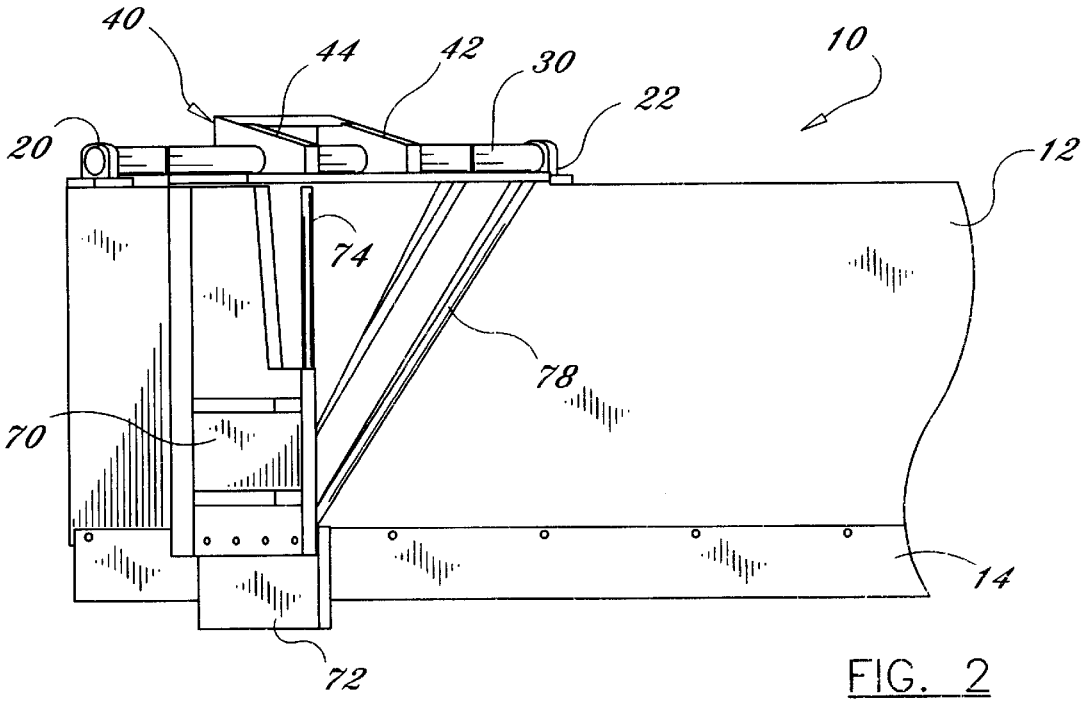
FIG. 2 is a front view of the present invention attached to a plow blade.

As shown in FIGS. 1 and 2 of the drawings, a pivot structure 30 is secured to the opposing brackets 20, 22. The pivot structure 30 is typically comprised of a shaft rotatably positioned within a tubular structure including bearings, bushings or other appropriate components to allow free rotation of the shaft. As best shown in FIG. 1 of the drawings, the pivot axis of the pivot structure 30 is at an angle with respect to the face of the plow blade 12. The pivot axis of the pivot structure 30 is preferably orthogonal to the path of the snowplow and plow blade 12 during operation to align the deflector member 70 along the longitudinal path of the snowplow.

As shown in FIGS. 1 through 5 of the drawings, an arm member 40 is attached to the pivot structure 30. The arm member 40 is pivotally supported about the pivot structure 30 for allowing pivotal movement of the arm member 40 along a radial plane that is parallel to the path of the snowplow during operation.

Figure 3:
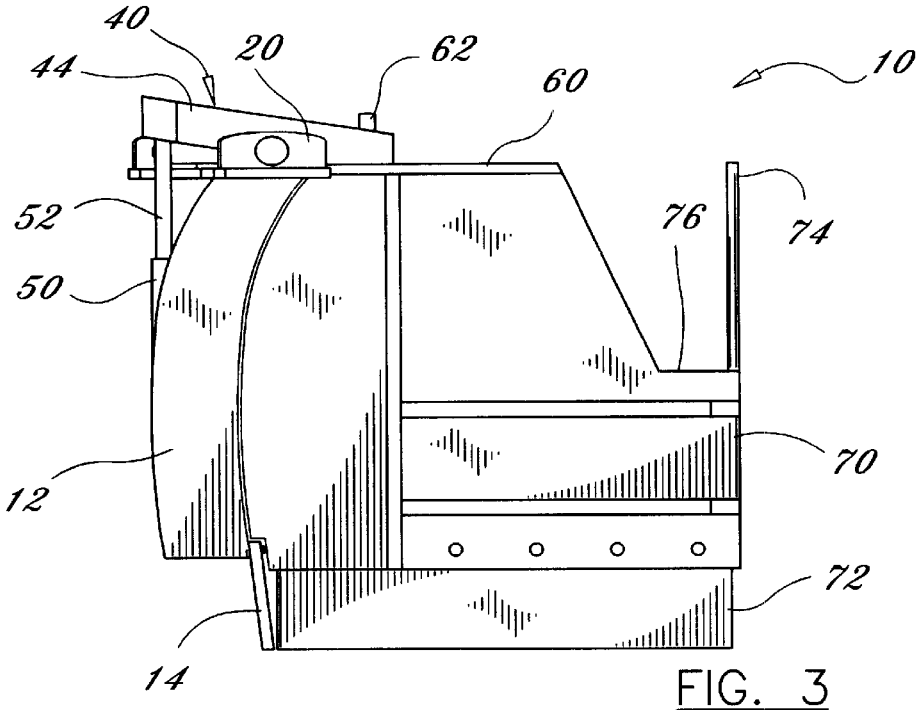
FIG. 3 is a side view of the present invention attached to a plow blade in the lowered position.
Figure 4:
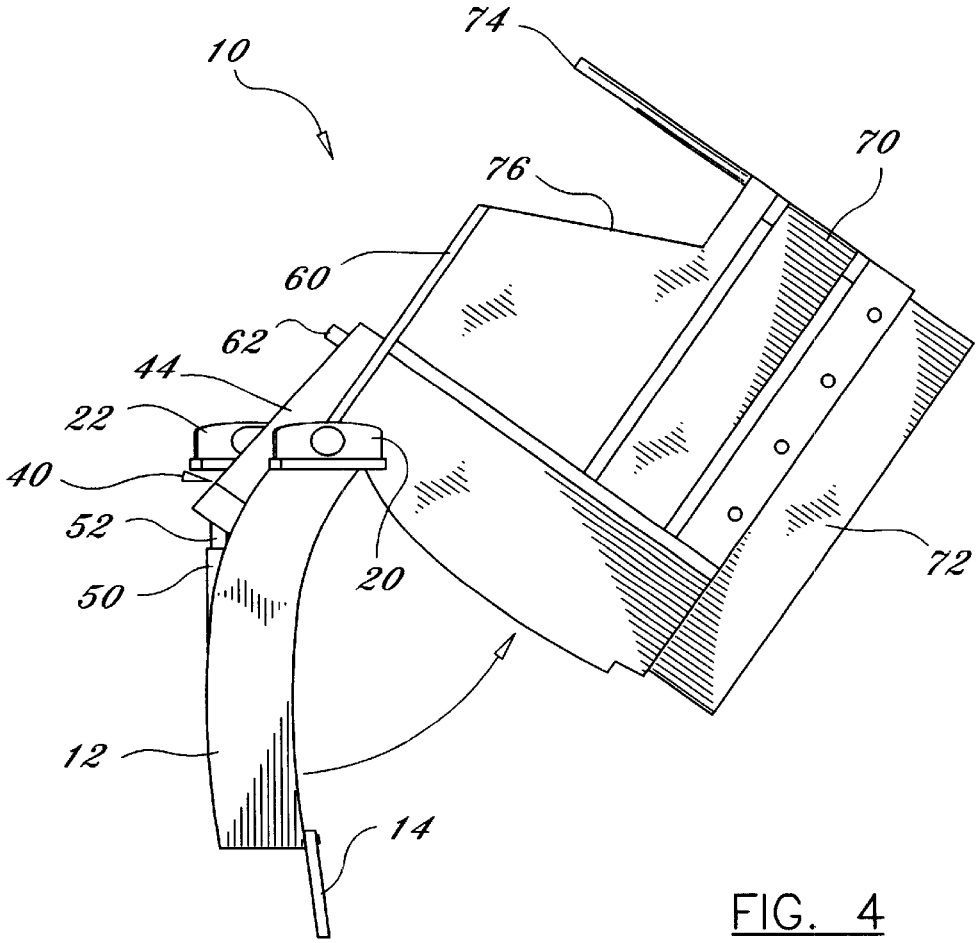
FIG. 4 is a side view of the present invention attached to a plow blade in the upright position.

As shown in FIGS. 3 through 5 of the drawings, an actuator 50 is mechanically connected between the rear surface of the plow blade 12 and the arm member 40. The actuator 50 pivots the arm member 40 about the pivot axis of the pivot structure 30 as shown in FIGS. 3 and 4 of the drawings. The actuator 50 is preferably comprised of at least one hydraulic cylinder, however it can be appreciated that the actuator 50 may be comprised of various other well-known devices.

As shown in FIGS. 1 through 5 of the drawings, an upper member 60 is preferably attached to the arm member 40 opposite of the actuator 50. The upper member 60 is preferably a flat structure that assists in maintaining the accumulated snow. At least one eyelet 62 is attached to an upper surface of the upper member 60 for allowing the connection of a hoist mechanism for lifting the plow blade deflector system 10 from the plow blade 12 when not utilized.

As shown in FIGS. 1 through 5 of the drawings, a deflector member 70 is secured orthogonally to the upper member 60. The deflector member 70 is formed to fit within the curved face of the plow blade 12 when in the lowered position as best shown in FIG. 3 of the drawings. The deflector member 70 extends substantially orthogonal to the pivot axis of the pivot structure 30 as best shown in FIG. 1 of the drawings. The deflector member 70 may be straight, curved or any other well-known shape.

As shown in FIGS. 2 through 4 of the drawings, a lower portion 72 extends from the deflector member 70. The lower portion 72 may be comprised of a resilient material such as hardened rubber, plastic or other known materials for engaging the ground surface during operation. As shown in FIGS. 3 and 4 of the drawings, the deflector member 70 may include a cutout 76 within the distal portion of the deflector member 70. As shown in FIGS. 1 and 2 of the drawings, one or more brace members 78 may be connected between the upper member 60 and the deflector member 70 for providing additional support to the deflector member 70 when capturing snow or other debris.

As shown in FIGS. 1 through 5 of the drawings, a marker 74 is preferably attached to the distal portion of the deflector member 70. The marker 74 is an elongate structure that may include indicia, stripes or other visual indicators to indicate to the operator of the snowplow the position of the deflector member 70. The marker 74 may be cylindrical shaped or any other well-known shape.

Figure 6:
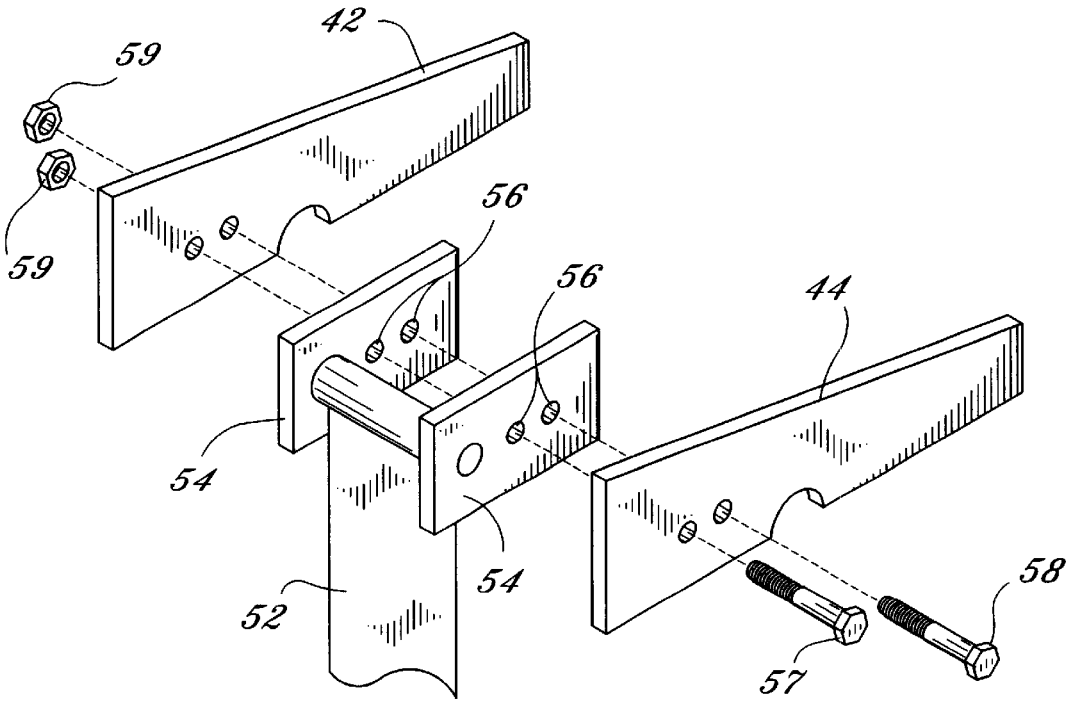
FIG. 6 is an exploded upper perspective view of the first and second arms.

As best shown in FIG. 6 of the drawings, a breakaway structure may be connected between the shaft 52 of the actuator 50 and the arm member 40 to allow the pivoting of the deflector member 70 in the situation where the plow blade 12 should tilt forwardly after engaging a hard object to prevent damage to the deflector member 70. As further shown in FIG. 6 of the drawings, a pair of side members 54 having a pair of apertures 56 are movably positioned between the first arm 42 and the second arm 44 of the arm member 40. The side members 54 are pivotally attached to the arms 42, 44 by a pivot pin 58 with a nut 59 attached thereto. The shaft 52 of the actuator 50 is attached to the side members 54 opposite of the pivot pin 58 as best shown in FIG. 6 of the drawings. A shear pin 57 is positioned through the arms 42, 44 and the side members 54 between the shaft 52 and the pivot pin 58 as further shown in FIG. 6 of the drawings. When a significant upward force is applied to the deflector member 70, the shear pin 57 is severed thereby allowing the arm member 40 to pivot about the pivot pin 58 with the shaft 52 of the actuator 50 freely moving the side members 54.

In use, the operator of the snowplow will typically have the deflector member 70 in the upright position to allow the snow and other debris to be dispensed to the side of the plow blade 12 as shown in FIG. 4 of the drawings. When the snowplow approaches a driveway or other area desired to be maintained clear of a snow windrow, the operator manipulates the actuator 50 so that the actuator 50 extends thereby pivoting the arm member 40 so that the deflector member 70 is lowered upon the face of the plow blade 12. The snow is thereby prevented from being dispensed to the side of the plow blade 12 and thereafter accumulates in front of the plow blade 12 and to the side of the deflector member 70. When the snow plow has passed the driveway or other area desired to be maintained unobstructed, the operator manipulates the actuator 50 so that the actuator 50 contracts thereby pivoting the arm member 40 so that the deflector member 70 is elevated as shown in FIG. 4 of the drawings. As the deflector member 70 is being elevated, the accumulated snow is allowed to be dispensed from the plow blade 12. The snowplow continues operating as usual until an other driveway is encountered where the above procedure is repeated.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A plow blade deflector system, comprising:

a bracket structure secured to a plow blade;

an arm member pivotally attached to said bracket structure having a pivot axis;

at least one actuator mechanically connected between said arm member and said plow blade;

a deflector member secured to said arm member opposite of said actuator; and a breakaway structure connected between a shaft of said actuator and said arm member for preventing damage to said deflector member, wherein said breakaway structure comprises:

a pair of side members having a first end and a second, wherein said first end is pivotally attached within said arm member by a pivot pin and wherein said second end is pivotally attached to said shaft of said actuator; and a shear pin positioned within said side members and said arm member between said first end and said second end of said side members.

2. The plow blade deflector system of claim 1, wherein said deflector member is formed to fit within a face of said plow blade.

3. The plow blade deflector system of claim 2, wherein said deflector member extends orthogonally with respect to said pivot axis.

4. The plow blade deflector system of claim 1, wherein said deflector member extends orthogonally with respect to said pivot axis.

5. The plow blade deflector system of claim 4, wherein said pivot axis is at an angle with respect to said plow blade.

6. The plow blade deflector system of claim 5, wherein said pivot axis is orthogonal to a longitudinal path of a vehicle supporting said plow blade.

7. The plow blade deflector system of claim 1, wherein said deflector member includes a marker.

8. The plow blade deflector system of claim 7, wherein said marker is an elongated structure extending upwardly from a distal end of said deflector member.

9. A plow blade deflector system, comprising:

a bracket structure secured to a plow blade;

a pivot structure attached to said bracket structure having a pivot axis;

an arm member pivotally attached to said pivot structure;

at least one actuator mechanically connected between said arm member and said plow blade;

an upper member attached to said arm member opposite of said actuator, wherein said arm member is a flat structure;

a deflector member secured to said upper member; and a breakaway structure connected between a shaft of said actuator and said arm member for preventing damage to said deflector member, wherein said breakaway structure comprises:

a pair of side members having a first end and a second, wherein said first end is pivotally attached within said arm member by a pivot pin and wherein said second end is pivotally attached to said shaft of said actuator; and a shear pin positioned within said side members and said arm member between said first end and said second end of said side members.

10. The plow blade deflector system of claim 9, wherein said deflector member is formed to fit within a face of said plow blade.

11. The plow blade deflector system of claim 10, wherein said deflector member extends orthogonally with respect to said pivot axis.

12. The plow blade deflector system of claim 9, wherein said deflector member extends orthogonally with respect to said pivot axis.

13. The plow blade deflector system of claim 12, wherein said pivot axis is at an angle with respect to said plow blade.

14. The plow blade deflector system of claim 13, wherein said pivot axis is orthogonal to a longitudinal path of a vehicle supporting said plow blade.

15. The plow blade deflector system of claim 9, wherein said deflector member includes a marker.

16. The plow blade deflector system of claim 15, wherein said marker is an elongated structure extending upwardly from a distal end of said deflector member.

17. The plow blade deflector system of claim 9, wherein said deflector member includes at least one brace member extending from said upper member to said deflector member.

18. The plow blade deflector system of claim 9, wherein said upper member includes at least one eyelet.

* * * * *